United States Patent [19]

Dorsey et al.

[11] Patent Number: 4,816,318

[45] Date of Patent: Mar. 28, 1989

[54] DECORATIVE SURFACE COVERING WITH GEOMETRIC PATTERNS AND COLORED PARTICLES

[75] Inventors: William C. Dorsey, Conestoga; Ann M. Wertz, York, both of Pa.

[73] Assignee: Armstrong World Industries, Inc., Lancaster, Pa.

[21] Appl. No.: 167,497

[22] Filed: Mar. 14, 1988

[51] Int. Cl.[4] ..... B05D 5/06

[52] U.S. Cl. ..... 428/167; 428/172; 428/173; 428/168

[58] Field of Search ..... 428/156–173

[56] References Cited

U.S. PATENT DOCUMENTS

| | | | |
|---|---|---|---|
| 1,873,098 | 8/1932 | Young | 428/167 |
| 1,989,704 | 2/1935 | Lequillon | 428/167 X |
| 2,057,873 | 10/1936 | Atwood | 428/167 X |
| 2,366,209 | 1/1945 | Morris | 428/167 |
| 2,587,594 | 3/1952 | Chavannes et al. | 428/167 X |
| 3,305,381 | 2/1967 | van Wagener | 428/167 X |
| 3,804,657 | 4/1974 | Eyman et al. | 428/172 X |
| 3,810,813 | 5/1974 | Ellis | 428/172 |
| 3,931,429 | 1/1976 | Austin | 428/172 X |
| 3,958,043 | 5/1976 | McKee, Jr. et al. | 428/172 X |
| 4,068,030 | 1/1978 | Whitman | 428/172 X |
| 4,126,727 | 11/1978 | Kaminski | 428/172 |
| 4,214,028 | 7/1980 | Shortway et al. | 428/172 X |
| 4,320,163 | 3/1982 | Schwartz | 428/172 X |

*Primary Examiner*—Naney A. B. Swisher

[57] ABSTRACT

A surface covering product is disclosed which comprises a substrate material, a granular material layer and discrete elements pressed into the granular material. The granular material appears as colored particles of material in the area around the discrete elements and are partially visable through the discrete elements because of their positioning below the discrete elements.

4 Claims, 1 Drawing Sheet

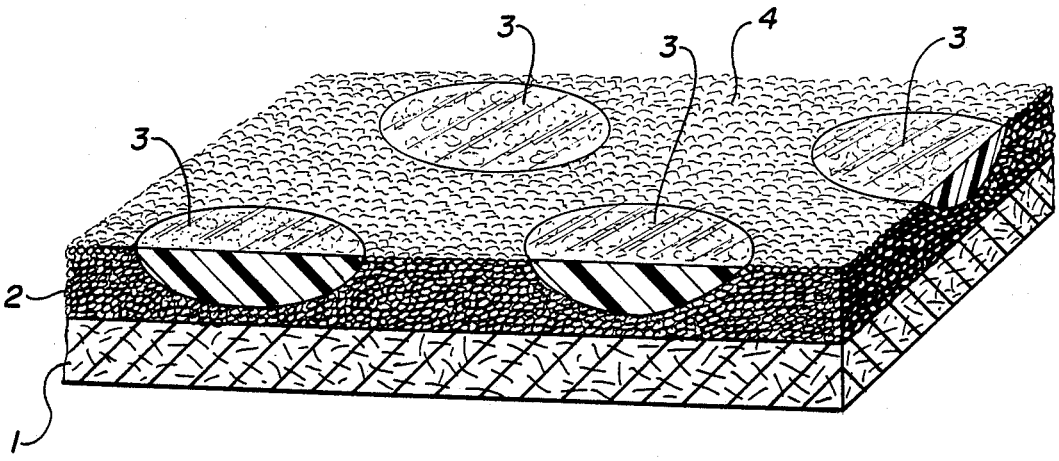
3
3
4
3
3
2
1

DECORATIVE SURFACE COVERING WITH GEOMETRIC PATTERNS AND COLORED PARTICLES

CROSS-REFERENCE TO RELATED APPLICATION

The present application is an improvement over copending application Ser. No. 139,768 filed Dec. 30, 1987.

BACKGROUND OF THE INVENTION

1. Field of the Invention

The present invention relates to a surface covering product. In particular, the present invention relates to a surface covering product having geometric transparent or translucent elements on the decorative surface, these elements surrounded by clearly defined colored particles and the elements showing therethrough partially obscured colored particles.

2. Description of the Prior Art

It is known in the prior art to have a surface covering product comprising a substrate; a first sealing layer substantially covers the substrate; a second layer of granular material substantially covers the first sealing layer; and, a third layer partially covering and inserted into said granular layer, said third layer comprising discrete inverted geometric-shaped colored portions of a thixtropic plastic material. The granular material is seen around the discrete geometric portions of the third layer.

SUMMARY OF THE INVENTION

The invention is directed to a decorative surface covering product which has a substrate and thereon a layer of fused granular stencil vinyl fine material substantially covering said substrate and bonded thereto. A layer of discrete inverted raised elements extends completely into the layer of granular material. The bases of the raised elements are level with the upper surface of the granular material and form a geometric design on the decorative surface of the granular material. The granular material is stencil vinyl fines which appear as particles of differing colors. The raised elements are transparent or translucent and when positioned within the colored granular layer of different color particles, the raised elements are visable on the decorative surface of the granular material. The granular layer appears as colored dots surrounding the discrete elements. Also, the granular material appears in a partially obscured or blurred configuration below the transparent or translucent elements.

BRIEF DESCRIPTION OF THE DRAWING

The drawing shows a perspective view with a cross-sectional view of the present invention.

DETAILED DESCRIPTION OF THE INVENTION

U.S. Pat. No. 4,709,631 shows a surface covering product comprising a substrate material, a non-porous coating upon said substrate material and raised elements selectively disposed upon said coating, which raised elements comprise a thixotropic plastic containing particles of solid material. The raised elements disclosed in the above-cited patent, however, are intended to increase the wear and slip resistance of the surface covering product and form raised areas on the surface covering product.

In the drawing herein, the product is shown with a substrate 1 covered with a matrix 2 of small resin particles of a stencil vinyl fine material. Into the granular material 2 is positioned geometric elements 3 which extend into the granular material and form a decorative geometric design on the upper surface 4 of the granular material. It can be seen that the granular material appears around the elements 3 and the granular material is of different color and provides a multi-color spot effect in the area around the elements 3. Further, some of the granular material 2 below the elements 3, due to the elements 3 being transparent or translucent, are shown in a diffused or blurred or partly obscured manner through the elements 3 to provide a blurred multi-colored dot effect in the elements 3.

The substrate 1 is not critical to the invention herein. It is believed that any of the substrates normally employed in the surface covering field can be employed in the practice of the present invention. The substrate could be a web of felted fibers which are impregnated with a bituminous material. Further, the substrate could be a glass fiber backing which has been saturated with a plastisol. Further, the backing could be a vinyl sheet.

The granular layer 2 is a broad term used to describe a small particle resin material structure that is flowable in the manner of dry sand. The granular material is what is called a stencil mix wherein the granular material is formed from partially plasticized PVC-filled particles. The material is not a pure vinyl particle, but is a vinyl particle containing a filler which is normally limestone. It is important to the invention herein that the particles be of small size and the particles themselves be colored a number of different colors.

The discrete elements 3 may be in any shape or pattern, however, geometrics such as repeated patterns of raised circles, squares, diamonds and the like have been demonstrated to be effective visually. The discrete elements may be from about three one-thousandths of an inch (0.003") to about eight one-hundredths of an inch (0.08") in diameter size on surface 4. The raised elements cover from about ten percent (10%) to fifty percent (50%) of the total surface area 4 in the final product in order to provide an effective geometric design to the surface of the product. The raised elements are actually printed on a substrate which is a release carrier and are formed from a thixotropic material which provides them with their geometric shape because they are printed with a stencil printer. The release carrier with the raised discrete elements printed thereon is turned upside down so that the discrete elements may be pressed into the granular material. After the product has been consolidated and fused, the release carrier is removed and that surface of the product so formed constitutes the decorative layer with the discrete elements being pressed into the granular material. The base of the discrete elements which engages the release carrier are in the same plane as to the top of the granular material and this forms a flat surface which is the decorative surface of the flooring product and constitutes the wear layer of the floor product.

An example of the product would involve the use of a quantity of plastisol prepared from the following materials:

| | | Weight Percent |
|---|---|---|
| Primary Plasticizer | Dioctyl Phthalate | 13.97 |
| Plasticizer | Texanol Isobutyrate TXIB | 9.40 |
| Stabilizer/Plasticizer | Epoxidized Soya Oil | 1.55 |
| Stabilizer | Zinc Neodecanoate (8%) | 0.29 |
| Stabilizer | Barium Neodecanoate (15%) | 0.49 |
| Viscosity Depressant | Byk 4015 | 1.43 |
| Surfactant | Surfynol 104-A | 2.78 |
| PVC Resin | Goodyear M-70 | 20.88 |
| PVC Resin | Hooker 6337 | 48.72 |
| Fumed Silica | Aerosil | 0.49 |
| | | 100.00 |

The initial viscosity of the above plastisol is measured by a Brookfield Viscometer using a No. 6 spindle at 20 revolutions per minute and its initial viscosity was about 130 poise, but it did rise to approximately 160 poise. A small additional portion of Isobutyrate Plasticizer was added as needed to adjust the viscosity to between 100 poise and 110 poise.

The plasticizer prepared in this manner was then rotary screen printed in a pattern of small geometric discrete elements onto a release paper carrier and fused by passing through two air-impingement ovens heated to 390° F. at a line speed of 20 feet per minute (20 ft./min.).

An overall lay-up of fine grind mottled stencil vinyl fines, i.e. partially plasticized polyvinyl chloride particles with filler, having a particle size which allows them to pass through a standard 20-mesh U.S. Sieve was applied to a substrate with a grid-type stencil. The release paper with the printed raised areas was then positioned so that the printed side of the paper was brought in contact with the stencil mix. As the release paper and stencil fines are carried into a press, the printed discrete elements are transferred and pressed into the underlying stencil vinyl mix in a consolidation employing a double press and pad set up with a 12-second dwell time. The top platen of the first press was heated to between 290° F. and 295° F. and the bottom platen was heated to 250° F., the press subjecting the sample to a pressure of about 200 to 220 pounds per square inch. The material was then repressed with an embossing plate. The top plate was run at 290° F. with an unheated bottom platen, and the dwell time was seven seconds, while the press subjected the sample to a pressure of about 110 pounds per square inch. The second press need not use an embossing plate.

The release paper was then stripped away leaving the plastisol discrete elements as part of the consolidated flooring structure. The discrete elements appear to be surrounded by the different color stencil vinyl fines which had been formed so as to be of plural colors. The plastisol which formed the discrete elements could be either transparent or translucent and the stencil fines thereunder would be visable through the discrete elements in a blurred manner to provide a blurred colored dot design below the discrete elements.

What is claimed is:

1. A decorative surface covering product comprising:

(a) a substrate;

(b) a layer of fused colored stencil vinyl fines forming a granular material substantially covering said substrate and bonded thereto; and (c) a layer of discrete inverted substantially transparent raised elements of a cured thixotropic plastic material extending completely into the layer of granular material, whereby the colored fines are clearly visible in the areas between the raised elements and appear as blurred colors through the raised elements.

2. A decorative surface covering product of claim 1 wherein the decorative surface of the granular material, opposite to the surface thereof bonded to the substrate, has the inverted raised elements extending thereinto so that the raised elements are visable on the decorative surface of the granular material whereby the raised elements form a gerometric design on the decorative surface of the granular elements.

3. A decorative surface covering product of claim 2 wherein the granular material appears as particles of different colors.

4. A decorative surface covering of claim 3 wherein the discrete raised elements are at least transparent or translucent and arranged in a geometric pattern design, and when positioned within the colored granular layer of different color particles, but visable on the decorative surface thereof, the pattern design of the discrete elements provides the decorative surface of the granular layer with a discrete geometric pattern, with the discrete elements surrounded by colored particles clearly visable in the area between the discrete elements, and in the area below the discrete elements the colored particles appear in a blurred colored particle pattern partially visable through the transparent or translucent discrete elements.

* * * * *